US006766125B1

(12) United States Patent
Izumi

(10) Patent No.: US 6,766,125 B1
(45) Date of Patent: Jul. 20, 2004

(54) IMAGE FORMING APPARATUS

(75) Inventor: Takao Izumi, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/382,851

(22) Filed: Mar. 7, 2003

(51) Int. Cl.[7] ..... G03G 15/16
(52) U.S. Cl. ..... 399/66; 399/101
(58) Field of Search ..... 399/45, 66, 101, 399/128, 297, 313, 314, 308, 391, 392

(56) References Cited

U.S. PATENT DOCUMENTS 5,717,981 A * 2/1998 Yamanaka ..... 399/101
5,884,121 A * 3/1999 Kyung ..... 399/66
6,035,154 A * 3/2000 Takahata et al. ..... 399/66

FOREIGN PATENT DOCUMENTS

JP 3-69978 A 3/1991

* cited by examiner

*Primary Examiner*—Hoang Ngo
(74) *Attorney, Agent, or Firm*—Foley & Lardner LLP

(57) ABSTRACT

A control unit uses electric field generating means (power supply) to effect a control to set a time period of alternate application of positive and negative bias voltages to a secondary transfer roller to be less than a time period corresponding to a single continuous rotation of the transfer rotary body.

9 Claims, 4 Drawing Sheets

IMAGE FORMING APPARATUS

BACKGROUND OF THE INVENTION

The present invention relates to an image forming apparatus, such as a color electronic copying machine, which reads an image on an original and forms an image using an electrophotographic process.

In recent years, color images have frequently been handled in offices. An increasing number of electrophotographic image forming apparatuses, in particular, color printers and color multi-functional peripherals (color MFPs), have been installed in offices.

At present, in many offices with a certain scale, a black-and-white copying machine and a color printer are used in combination. As color printers have increasingly gained popularity among smaller-scale offices, there is a demand for color MFPs, which could replace black-and-white copying machines.

In this case, it is desired that the color MFP have the same black-and-white copying performance as the black-and-white copying machine and also have a color print function. At present, a most prevalent system employed in color image forming apparatuses is one using an intermediate transfer medium. Images of four colors are successively developed on a photosensitive body, and the developed images are successively transferred on the intermediate transfer medium. The superimposed images of the four colors on the intermediate transfer medium are batch-transferred on a paper sheet.

In this type of apparatus, in most cases, a secondary transfer member that comes in contact with the back side of the paper sheet is used in order to batch-transfer the images on the sheet. In case of paper jam, the secondary transfer member comes in direct contact with the intermediate transfer medium carrying the toner images, and the secondary transfer member is stained with toner. Consequently, the back side of a paper sheet for the next print operation is also stained. In the case of double-side printing, both the image surface and back surface of the paper sheet are stained.

Some methods for removing the stain have been proposed. Such methods include a method wherein toner of a stain is mechanically removed by a blade, etc., and a method wherein an electric field is applied to toner of a stain and the toner is recovered to the intermediate transfer medium side.

In particular, the method using the electric field has such a problem that the toner cannot efficiently be recovered by simple application of an electric field.

BRIEF SUMMARY OF THE INVENTION

The object of an aspect of the present invention is to provide an image forming apparatus wherein an electric field is applied to toner stain on a secondary transfer member, thereby efficiently recovering the toner to an intermediate transfer medium side.

In order to achieve the object, the present invention may provide an image forming apparatus having image forming means for forming a plurality of toner images on a movable image carrying body, an intermediate transfer member on which the toner images formed by the image forming means are transferred, and a transfer rotary body that transfers the toner images, which are transferred on the intermediate transfer member, onto a transfer medium, the apparatus comprising: a first application unit that applies a negative voltage to the transfer rotary body; a second application unit that applies a positive voltage to the transfer rotary body; a switching unit that alternately switches the first application unit and the second application unit, which apply voltages to the transfer rotary body; and a control unit that effects a control to set a time period of alternate voltage application switched by the switching unit to be less than a time period corresponding to a single continuous rotation of the transfer rotary body relative to the intermediate transfer member.

Additional objects and advantages of an aspect of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of an aspect of the invention.

DETAILED DESCRIPTION OF THE INVENTION

Embodiments of the present invention will now be described with reference to the accompanying drawings.

Figure 1:
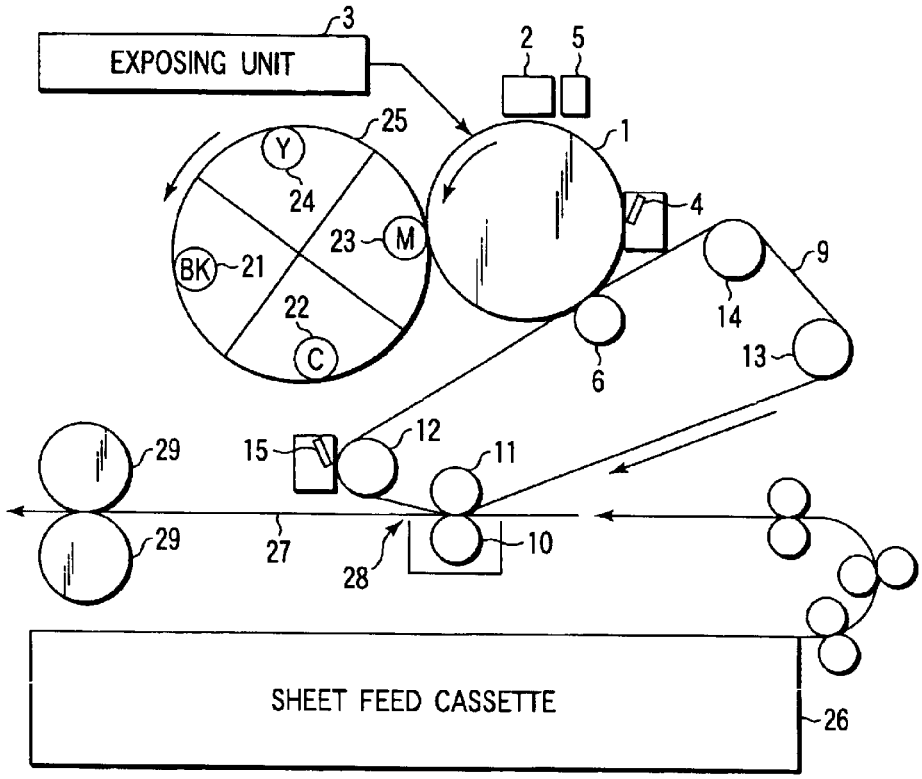
FIG. 1 is a cross-sectional view schematically showing the structure of a color image forming apparatus using an electrophotographic process according to an image forming apparatus of an embodiment of the present invention.

FIG. 1 schematically shows the structure of a color image forming apparatus using an electrophotographic process according to an image forming apparatus of an embodiment of the present invention.

A precharger 2 uniformly coats a rotating photosensitive body 1 with charge. Based on image information, an exposing unit 3 scans exposure light over the surface of the photosensitive body 1, thereby forming an electrostatic latent image on the photosensitive body 1. In this case, the image information used for the exposure is represented by single-color image signals obtained by color-separating a desired full-color image into yellow, magenta, cyan and black color signals.

The electrostatic latent image on the photosensitive body 1 is developed with predetermined yellow, magenta, cyan and black toners supplied from a developing unit 20. The developing unit 20 includes four developing devices which are gathered in a substantially cylindrical shape, as will be described later. Thus, the developed toner images of the respective colors are formed on the photosensitive body 1.

The respective color toner images on the photosensitive body are successively transferred on an intermediate transfer belt (intermediate transfer medium) 9 rotated in synchronism with the photosensitive body 1 such that the toner images are superimposed in the order of yellow, magenta, cyan and black. The superimposed toner image on the intermediate transfer belt 9 is batch-transferred on a transfer sheet 27 conveyed to a secondary transfer section 28 by means of a secondary transfer roller (secondary transfer member) 10. Then, the transferred image on the transfer sheet 27 is fixed by a fixing device 29 and thus a full-color image is formed. The transfer sheet 27 is fed from a sheet feed cassette 26.

After the toner images on the photosensitive body 1 are transferred on the intermediate transfer belt 9 by a primary transfer roller 6, residual toner on the photosensitive body 1 is removed by a cleaner 4, and charge on the photosensitive body 1 is eliminated by a charge eraser 5.

The intermediate transfer belt 9 is passed over a driving roller 12, a tension roller 13 and a driven roller 14. The intermediate transfer belt 9 is rotated by the driving roller 12. After the toner on the intermediate transfer belt 9 is transferred onto the transfer sheet 27 by the secondary transfer roller 10 and a backup roller 11, residual toner on the intermediate transfer belt 9 is removed by a cleaner 15.

The developing unit 20 is a revolver-type developing unit. The developing unit 20 comprises a black developing device (hereinafter referred to as "BK developing device") 21, a cyan developing device (hereinafter "C developing device") 22, a magenta developing device (hereinafter "M developing device") 23, a yellow developing device (hereinafter "Y developing device") 24, a developing device holder 25 for holding these developing devices, and a revolver drive section (not shown) for rotating the developing device holder 25.

The developing devices 21 to 24 have developing rollers (not shown) that rotate while putting developer in contact with the surface of the photosensitive body 1, thereby to develop an electrostatic latent image on the photosensitive body. In the standby state, the developing unit 20 stands by in a non-contact state in a position for development with the BK developing device 21. When the operation is started, the exposing unit 3 begins forming an electrostatic latent image on the photosensitive body 1 by optical write (exposure) by applying a laser beam based on the image signals (image information) (hereinafter an electrostatic latent image formed by a BK image signal is referred to as "BK latent image").

In order to develop the BK latent image on the photosensitive body 1 from its front edge portion, the rotation of the developing device sleeve (not shown) is started before the front edge portion of the latent image on the photosensitive body 1 reaches the development position of the BK developing device 21, and the BK latent image on the photosensitive body 1 is developed with black toner (BK toner).

When the rear end portion of the latent image on the photosensitive body 1 has passed over the development position of the BK developing device 21, the revolver drive section (not shown) is immediately rotated from the development position of the BK developing device 21 to the development position of the developing device of the next color (the C developing device 22 in this example). Thereby the developing device holder 25 is rotated and the development for the next color is performed.

With the rotation of the intermediate transfer belt 9, the BK toner image, C toner image, M toner image and Y toner image are successively transferred on the intermediate transfer belt 9. At last, these toner images are superimposed on the intermediate transfer belt 9 in the order of BK, C, M and Y, and a full-color toner image is formed.

The intermediate transfer belt unit, as shown in FIG. 1, includes the primary transfer roller 6, driving roller 12, backup roller 11, tension roller 13 and driven roller 14, and the endless intermediate transfer belt 9 is passed over these rollers with tension.

The intermediate transfer belt 9 is 125 $\mu$m thick and formed of polyimide. The intermediate transfer belt 9 has a volume resistance of $10^9$ Ωcm and a surface resistance of $10^{10}$ Ωcm/□ (measured by a resistivity meter (model name: "Hiresta") manufactured by Dai Instruments Co., Ltd.).

The secondary transfer roller 10 is held in the secondary transfer section 28. The secondary transfer section 28 includes an attaching/detaching mechanism (not shown) for selectively shifting the secondary transfer roller 10 between a position where it is put in contact with the backup roller 11 via the intermediate transfer belt 9 at the secondary transfer position, and a position where it is separated from the backup roller 11.

The secondary transfer roller 10 has an outside diameter of 28 mm and is constructed such that an epichlorohydrin rubber tube is coated on a surface of a sponge of epichlorohydrin rubber, with a rubber hardness being 25° to 30° (Asker C) and a volume resistance being $10^7$Ω.

The backup roller 11 is an electrically grounded aluminum roller. When the toner image is transferred on the transfer sheet 27, the aforementioned attaching/detaching mechanism (not shown) is operated in synchronism with the timing at which the toner image on the intermediate transfer belt 9 comes to the secondary transfer section 28, thereby brining the secondary transfer roller 10 into contact with the intermediate transfer belt 9.

Further, in synchronism with this operation, the transfer sheet 27 is fed from the sheet feed cassette 26 and put in contact with the intermediate transfer belt 9. Then, the sheet 27 is inserted in a transfer nip (transfer contact portion) formed between the intermediate transfer belt 9 and secondary transfer roller 10.

When the transfer sheet 27 is inserted in the transfer nip, a bias voltage of about +1 KV is applied to the second transfer roller 10 almost at the same time, and the toner image is transferred onto the transfer sheet 27.

The moment the rear end of the transfer sheet 27 has gone out of the transfer nip, the bias voltage to the secondary transfer roller 10 is turned off and the attaching/detaching mechanism is operated to separate the secondary transfer roller 10 from the intermediate transfer belt 9.

In the meantime, if the secondary transfer operation is performed while the sheet is not fed due to a paper jam, the toner would be transferred and retained on the secondary transfer roller 10. In order to remove the toner, a jam-rectifying operation is performed in the following manner.

To begin with, the intermediate transfer belt 9 is rotated, and the attaching/detaching mechanism of the secondary transfer unit is activated to put the secondary transfer roller 10 in contact with the intermediate transfer belt 9, thus rotating the secondary transfer roller 10. Upon contact between them, positive and negative bias voltages are alternately applied to the secondary transfer roller 10, and the toner attached to the secondary transfer roller 10 is shifted to the intermediate transfer belt 9. The toner shifted to the intermediate transfer belt 9 is mechanically removed by the cleaning blade of the cleaner 15.

A first embodiment of the present invention will now be described.

In the above-described process, the normal polarity of toner is negative. Thus, most of the toner attached to the secondary transfer roller 10 is negative. However, some portion of the toner has an opposite polarity, i.e. a positive polarity.

Figure 2:
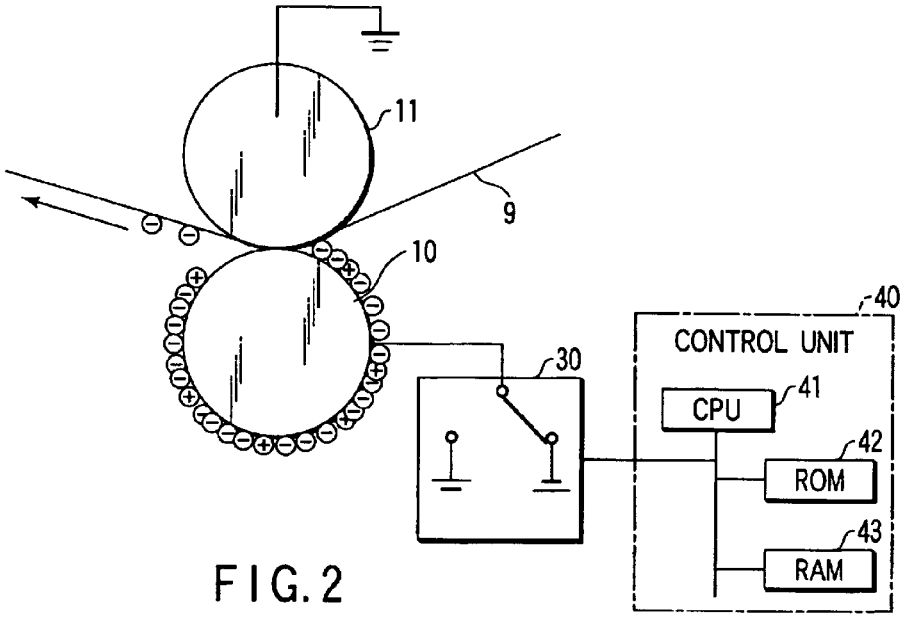
FIG. 2 is a block diagram showing a secondary transfer section and a control system thereof.

FIG. 2 shows the secondary transfer section 28 and a control system thereof. Electric field generating means (power supply) 30 is connected to the secondary transfer roller (transfer rotary body) 10. The electric field generating means 30 includes a first application unit (power supply) for applying a negative bias voltage, a second application unit (power supply) for applying a positive bias voltage, and a switching unit for switching these application units. In other words, the electric field generating means 30 includes a first generation unit for generating a first electric field at the secondary transfer roller 10 and a second generation unit for generating a second electric field at the secondary transfer roller 10.

The electric field generating means 30 is controlled by a control unit 40. The control unit 40 comprises a CPU 41 that controls the entirety of the color image forming apparatus, a ROM 42 that stores control programs, etc., and a RAM 43 that temporarily stores data.

Figure 3:
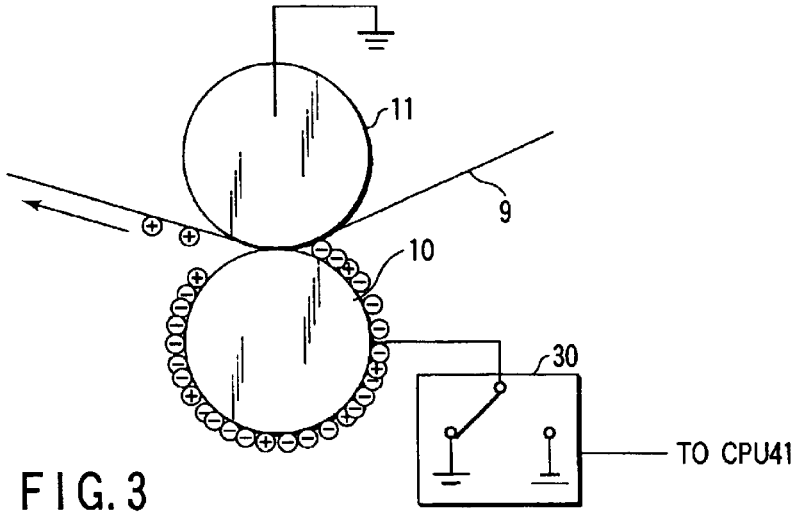
FIG. 3 is a view for explaining a shift of positive toner to an intermediate transfer belt side.

The CPU 41 activates the electric field forming means 30 to apply a negative bias voltage, thereby shifting the negative toner to the intermediate transfer belt 9, as shown in FIG. 2, and also to apply a positive bias voltage, thereby shifting the positive toner to the intermediate transfer belt 9, as shown in FIG. 3. Hence, whichever polarity the toner has, the toner can be recovered onto the intermediate transfer belt 9.

However, if positive and negative bias voltages are continuously applied to the secondary transfer roller 10 in the state in which no paper sheet is interposed, a phenomenon called "power-on degradation" would occur wherein the resistance of the secondary transfer roller 10 gradually lowers and an excessive current flows. In a worst case, voltage leak occurs and a transformer, intermediate transfer belt 9 or secondary transfer roller 10 may be damaged.

This phenomenon is aggravated in accordance with an increase in the number of times of passing of a specific location of the secondary transfer roller 10 through the transfer nip. In other words, if the turn-on time exceeds the time of a first rotation of the secondary transfer roller 10 and continues even after a second rotation of the secondary transfer roller 10 beings, the phenomenon becomes worse. Then, if the turn-on time further continues even after a third rotation of the secondary transfer roller 10 begins, the phenomenon becomes still worse.

Figure 4:
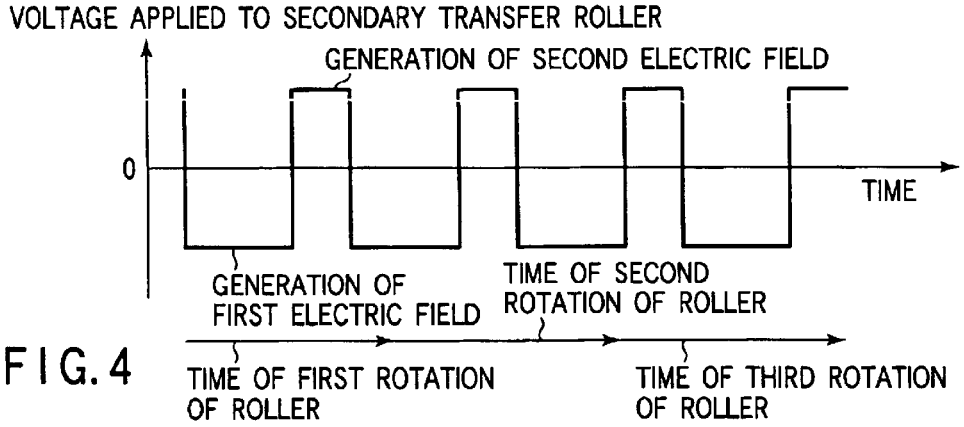
FIG. 4 is a view for explaining a voltage applied to a secondary transfer roller.
Figure 5:
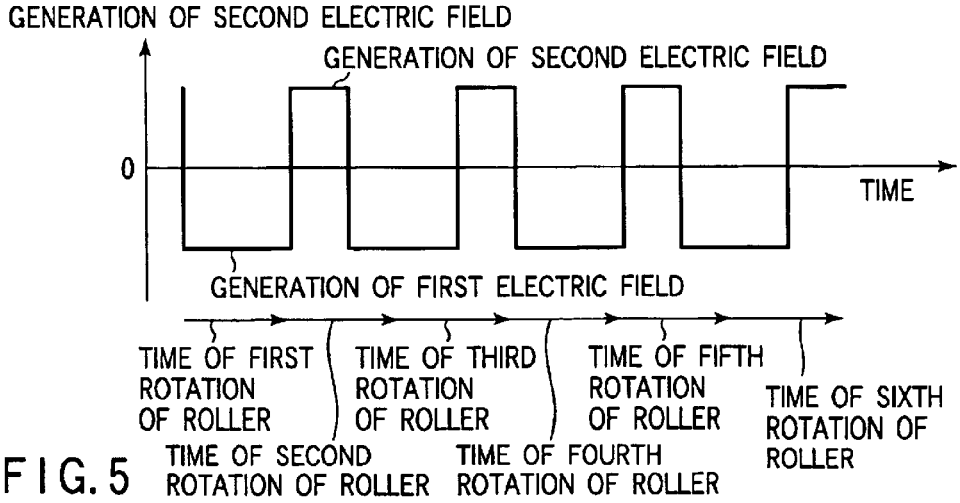
FIG. 5 is a view for explaining a voltage applied to the secondary transfer roller.

Thus, as shown in FIG. 4, the time of alternate application of each of the negative and positive voltages is made less than the time of a single continuous rotation of the roller. Thereby, the problem of the power-on degradation can be solved. Specifically, if the peripheral speed of the secondary transfer roller 10 is v [mm/s] and the outside diameter of the secondary transfer roller 10 is d [mm], the time, within which the bias voltage of each polarity can continuously be applied, is less than t [s], where $t=2\pi d/v$.

In the first embodiment, the process speed, i.e. the peripheral speed of the secondary transfer roller 10, is 200 mm/s, and the outside diameter of the secondary transfer roller 10 is 28 mm. Therefore, no problem arises if the time of application of the bias voltage of each polarity is set at about 440 msec or less.

The bias voltage (for generating the second electric field) for recovering the reversely charged (positive) toner is +1 kV, and the bias voltage (for generating the first electric field) for recovering the normally charged (negative) toner is −1 kV.

A second embodiment of the invention will now be described.

Normally, a bias voltage applied to recover normally charged (negative) toner is reverse to a bias voltage applied to transfer the toner image. In this case, no problem arises even if the bias voltage is applied for a relatively long time.

However, a bias voltage applied to recover reversely charged (positive) toner is equal to a bias voltage applied to transfer the toner image. Consequently, the power-on degradation tends to be aggravated.

The problem of power-on degradation in this case can be solved by setting, at least, the bias voltage applied to recover reversely charged (positive) toner to be less than the time corresponding to a single continuous rotation of the roller. Specifically, if the peripheral speed of the secondary transfer roller 10 is v [mm/s] and the outside diameter of the secondary transfer roller 10 is d [mm], the time, within which the bias voltage of each polarity can continuously be applied, is less than t [s], where $t=2\pi d/v$.

In the second embodiment, the process speed, i.e. the peripheral speed of the secondary transfer roller 10, is 200 mm/s, and the outside diameter of the secondary transfer roller 10 is 28 mm. Therefore, no problem arises if the time of application of the bias voltage applied to recover reversely charged (positive) toner is set at about 440 msec or less. The bias voltage (for generating the second electric field) for recovering the reversely charged (positive) toner is +1 kV, and the bias voltage (for generating the first electric field) for recovering the normally charged (negative) toner is −1 kV.

A third embodiment of the present invention will now be described.

If the peripheral speed of the secondary transfer roller 10 is v [mm/s] and the outside diameter of the secondary transfer roller 10 is d [mm], $T=2\pi d/v$. In this case, T [s] is the time corresponding to a single rotation of the secondary transfer roller 10. If the bias voltage applied to recover the normally charged (negative) toner is ta [s] and the bias voltage applied to recover the reversely charged (positive) toner is tb [s], the following conditions need to be satisfied:

$$0<tb<T, \text{ and } ta+tb\neq nT \ (n=1, 2, \ldots)$$

That is, it is necessary to meet the condition, $0<tb<T$, and not to meet the condition, $ta+tb=nT$.

If $0<tb<T$, and $ta+tb=nT$ ($n=1, 2, \ldots$), the bias voltage applied to recover the reversely charged (positive) toner is always applied to only a specific part of the secondary transfer roller 10 each time the roller rotates. As a result, the toner on the specific part is recovered to the belt, but toner on the other parts is not recovered and the back side of the sheet is stained.

Figure 6:
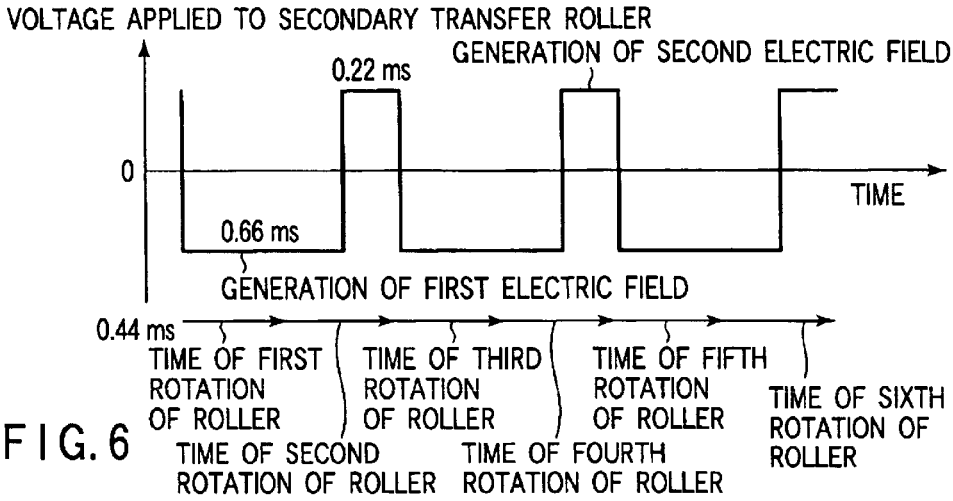
FIG. 6 is a view for explaining a voltage applied to the secondary transfer roller.

As shown in FIG. 6, in fact, the peripheral speed of the secondary transfer roller 10 is 200 mm/s, the outside diameter of the secondary transfer roller 10 is 28 mm, and T=0.44 [ms]. Under conditions of ta=0.66 [ms] and tb=0.22 [ms], eight sets of application of positive and negative biases to the secondary transfer roller 10, on the entire surface of which toner was intentionally coated, were conducted repeatedly. It was found that a small amount of toner, which was not recovered, remained on half the circumferential surface of the secondary transfer roller 10. The bias voltage for recovering the reversely charged (positive) toner was set at +1 kV, and the bias voltage for recovering the normally charged (negative) toner was set at −1 kV.

Figure 7:
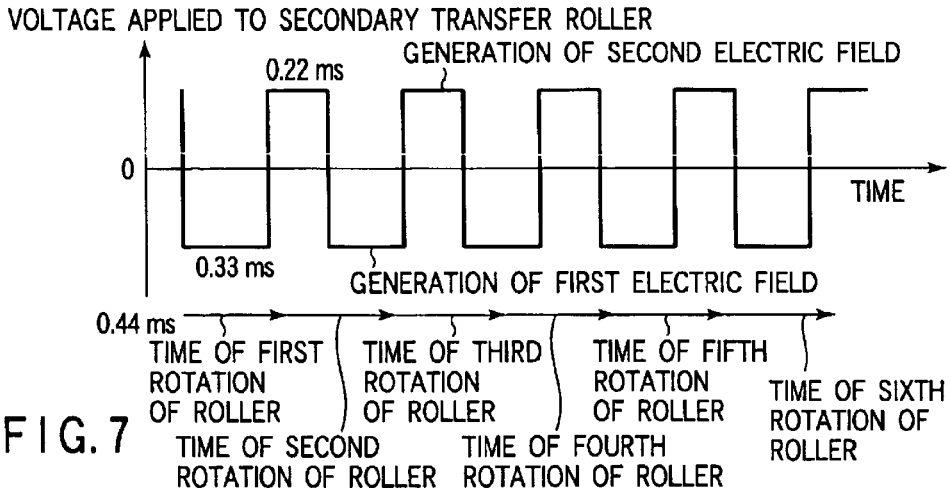
FIG. 7 is a view for explaining a voltage applied to the secondary transfer roller.

On the other hand, as shown in FIG. 7, under conditions of ta=0.33 [ms] and tb=0.22 [ms], the biases were similarly applied. It was found that little toner remained on the secondary transfer roller 10. In addition, under conditions of ta=0.55 [ms] and tb=0.22 [ms], the biases were similarly applied and it was found that little toner remained on the secondary transfer roller 10.

Figure 8:
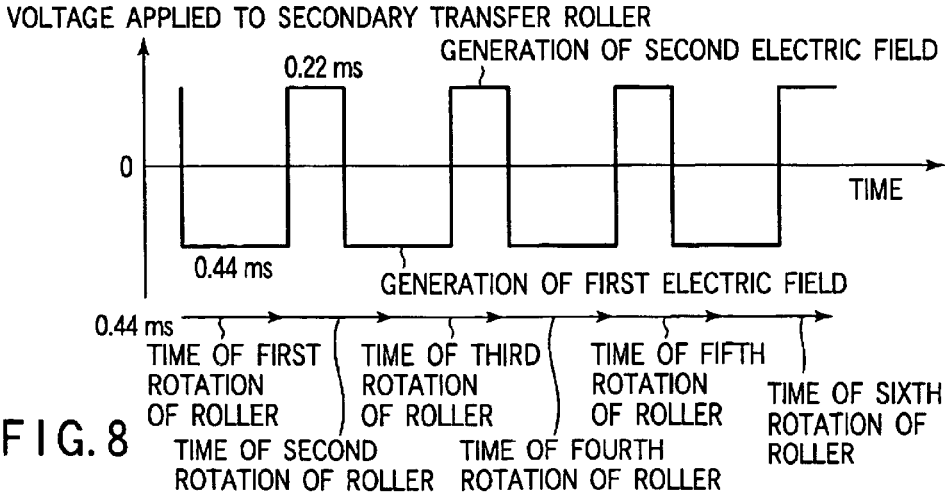
FIG. 8 is a view for explaining a voltage applied to the secondary transfer roller.

Furthermore, as shown in FIG. 8, under conditions of ta=0.44 [ms] and tb=0.22 [ms], the biases were similarly applied, and it was found that little toner remained on the secondary transfer roller 10 and at the same time the degree of power-on degradation was reduced. The reason appears to be that the bias voltage to the outer periphery of the secondary transfer roller 10, when attention was paid to one polarity, was applied continuously, without overlapping or excessive internals. The conditions for this case are 0<tb<T, and ta=nT (n=1, 2, . . . ).

A fourth embodiment of the invention will now be described.

The absolute value of the charge amount of reversely charged (positive) toner is much smaller than the absolute value of the charge amount of normally charged (negative) toner.

Figure 9:
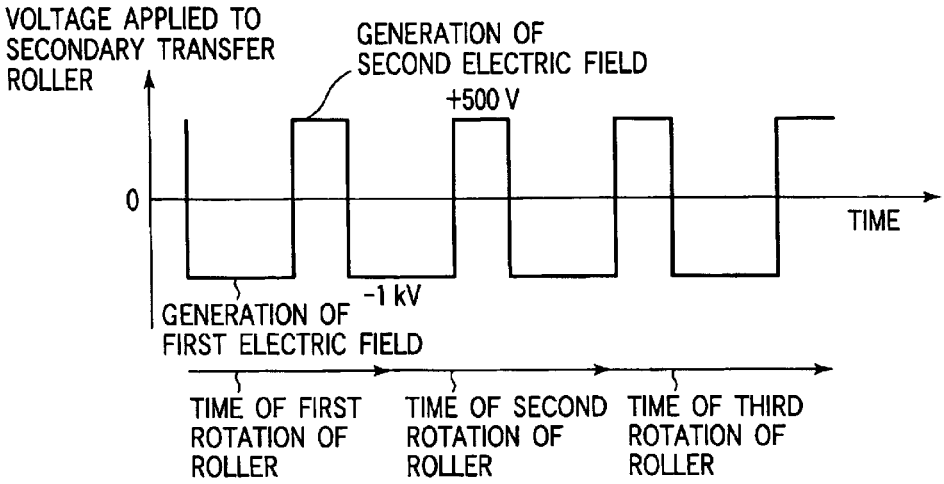
FIG. 9 is a view for explaining a voltage applied to the secondary transfer roller.

In the fourth embodiment, as shown in FIG. 9, the bias voltage for recovering the reversely charged (positive) toner is made lower than the bias voltage for recovering the normally charged (negative) toner. As a result, the toner recovery performance was fully exhibited, and the power-on degradation was suppressed because the application voltage was lowered. In the fourth embodiment, the bias voltage (for generating the second electric field) for recovering the reversely charged (positive) toner was set at +500V, and the bias voltage (for generating the first electric field) for recovering the normally charged (negative) toner was set at −1 kV.

A fifth embodiment of the present invention will now be described.

In the above-described process, the normal polarity of toner is negative. Thus, most of the toner attached to the secondary transfer roller 10 is negative. However, some portion of the toner has an opposite polarity, i.e. a positive polarity. To cope with this problem, the positive and negative bias voltages are applied, as described above, so that the toner of either polarity may be recovered to the intermediate transfer belt 9.

However, if the bias voltage of the same polarity as the polarity of the previously applied bias voltage is applied once again to a specific part of the secondary transfer roller 10 to recover toner, the recovery of toner is not easily performed in the second and following applications of the bias voltage. The reason appears to be that the toner with a charge amount, which is recoverable with the electric field generated by the previous bias voltage, was already recovered, and so most of the remaining toner cannot be separated from the secondary transfer roller 10 with the application of the same electric field at the second time.

Figure 10:
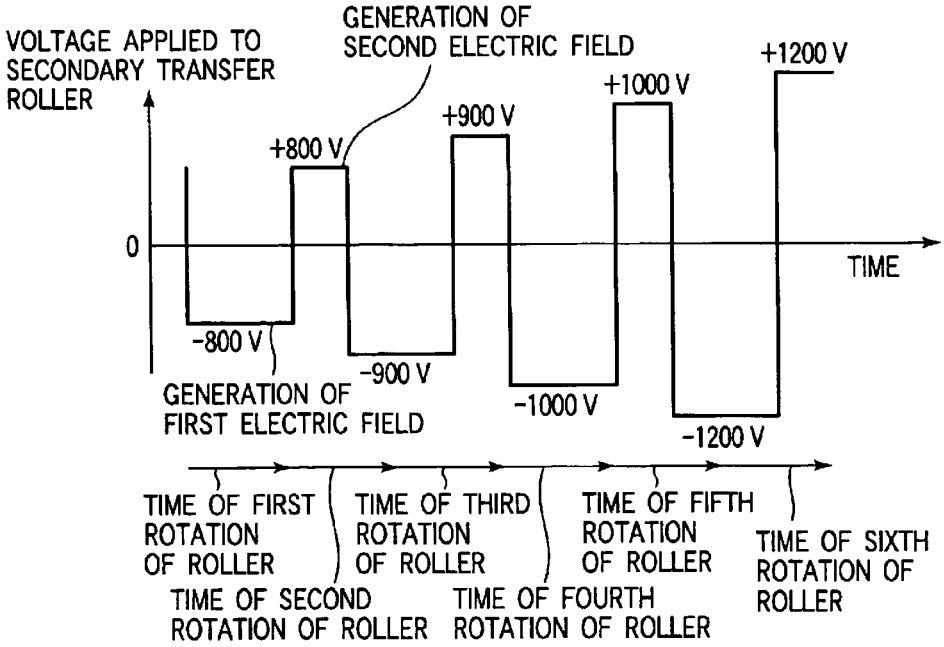
FIG. 10 is a view for explaining a voltage applied to the secondary transfer roller.

In the fifth embodiment, as shown in FIG. 10, the bias voltage applied at the second and following times is gradually increased, compared to the previously applied one. Thereby, the toner remaining on the secondary transfer roller 10 becomes easily recoverable.

In the fifth embodiment, the process speed, i.e. the peripheral speed of the secondary transfer roller 10, is 200 mm/s, and the outside diameter of the secondary transfer roller 10 is 28 mm. Toner is intentionally attached to the secondary transfer roller 10. The time of application of the bias voltage of each polarity is set at about 440 msec or less. The bias voltage (for generating the second electric field) applied for recovering the reversely charged (positive) toner at the first time is set at +800V, and the bias voltage (for generating the first electric field) applied for recovering the normally charged (negative) toner is set at −800V. Subsequently, the absolute value of the applied bias voltage is increased in units of 100V, and four sets of bias application are performed.

The case where four sets of bias application with the increase in units of 100V was compared to the case where four sets of bias application with the fixed value of ±800V. It turned out that in the case where the bias voltages were increased in units of 100V, the amount of residual toner on the secondary transfer roller 10 was successfully decreased in accordance with an increase in the number of sets of bias application.

The above-described embodiments may be combined. For example, the fourth and fifth embodiments may be combined.

As has been described above, according to the embodiments of the present invention, a stain on the back surface of a transfer paper sheet due to a stain on a secondary transfer roller can be eliminated in an intermediate transfer type image forming apparatus.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus having image forming means for forming a plurality of toner images on a movable image carrying body, an intermediate transfer member on which the toner images formed by the image forming means are transferred, and a transfer rotary body that transfers the toner images, which are transferred on the intermediate transfer member, onto a transfer medium, the apparatus comprising:

a first application unit that applies a negative voltage to the transfer rotary body;

a second application unit that applies a positive voltage to the transfer rotary body;

a switching unit that alternately switches the first application unit and the second application unit, which apply voltages to the transfer rotary body; and a control unit that effects a control to set a time period of alternate voltage application switched by the switching unit to be less than a time period corresponding to a single continuous rotation of the transfer rotary body relative to the intermediate transfer member.

2. The image forming apparatus according to claim 1, wherein the first application unit applies a negative bias voltage that shifts toner of the same polarity as a charge polarity of said toner from the transfer rotary body to the intermediate transfer member.

3. The image forming apparatus according to claim 1, wherein the first application unit applies a positive bias voltage that shifts toner of a charge polarity opposite to a charge polarity of said toner from the transfer rotary body to the intermediate transfer member.

4. The image forming apparatus according to claim 1, wherein the first application unit, the second application unit and the switching unit alternately generate, at the transfer rotary body, a first electric field that shifts toner of the same polarity as a charge polarity of said toner from the transfer rotary body to the intermediate transfer member, and a second electric field that shifts toner of a charge polarity opposite to a charge polarity of said toner from the transfer rotary body to the intermediate transfer member.

5. The image forming apparatus according to claim 1, wherein when the alternate voltage application is switched by the switching unit, the control unit effects a control to set at least a time period of voltage application by the second application unit to be less than a time period corresponding to a single continuous rotation of the transfer rotary body relative to the intermediate transfer member.

6. The image forming apparatus according to claim 1, wherein the control unit effects a control to meet a condition, $0<tb<T$, and not to meet a condition, $ta+tb=nT$ (n=an integer), where T is a time needed for a single rotation of the transfer rotary body, ta is a time of application by the first application unit, and tb is a time of application by the second application unit.

7. The image forming apparatus according to claim 1, wherein the control unit effects a control to meet a condition, $0<tb<T$, and a condition, $ta=nT$ (n=an integer), where T is a time needed for a single rotation of the transfer rotary body, ta is a time of application by the first application unit, and tb is a time of application by the second application unit.

8. An image forming apparatus having image forming means for forming a plurality of toner images on a movable image carrying body, an intermediate transfer member on which the toner images formed by the image forming means are transferred, and a transfer rotary body that transfers the toner images, which are transferred on the intermediate transfer member, onto a transfer medium, the apparatus comprising:

a first generation unit that generates, at the transfer rotary body, a first electric field that shifts toner of the same polarity as a charge polarity of said toner from the transfer rotary body to the intermediate transfer member;

a second generation unit that generates, at the transfer rotary body, a second electric field that shifts toner of a charge polarity opposite to a charge polarity of said toner from the transfer rotary body to the intermediate transfer member;

a switching unit that alternately switches the first electric field generated by the first generation unit and the second electric field generated by the second generation unit, the first and second electric fields being generated at the transfer rotary body; and a control unit that controls a time for alternate switching of the first electric field and the second electric field which are switched by the switching unit, and effects a control to set an intensity of the first electric field generated by the first generation unit to be greater than an intensity of the second electric field generated by the second generation unit.

9. An image forming apparatus having image forming means for forming a plurality of toner images on a movable image carrying body, an intermediate transfer member on which the toner images formed by the image forming means are transferred, and a transfer rotary body that transfers the toner images, which are transferred on the intermediate transfer member, onto a transfer medium, the apparatus comprising:

a first generation unit that generates, at the transfer rotary body, a first electric field that shifts toner of the same polarity as a charge polarity of said toner from the transfer rotary body to the intermediate transfer member;

a second generation unit that generates, at the transfer rotary body, a second electric field that shifts toner of a charge polarity opposite to a charge polarity of said toner from the transfer rotary body to the intermediate transfer member;

a switching unit that alternately switches the first electric field generated by the first generation unit and the second electric field generated by the second generation unit, the first and second electric fields being generated at the transfer rotary body; and a control unit that controls a time for alternate switching of the first electric field and the second electric field which are switched by the switching unit, and effects a control to make intensities of the first electric field and the second electric field greater than intensities of electric fields previously generated in the same directions, each time the switching is effected.

* * * * *